US011241139B2

(12) United States Patent
Jaske et al.

(10) Patent No.: US 11,241,139 B2
(45) Date of Patent: Feb. 8, 2022

(54) DISHWASHER WITH DRAIN ASSEMBLY AND CHECK VALVE

(71) Applicant: WHIRLPOOL CORPORATION, Benton Harbor, MI (US)

(72) Inventors: Matthew Jerel Jaske, Berrien Springs, MI (US); Antony M. Rappette, Benton Harbor, MI (US); John Alan Miller, Stevensville, MI (US); Todd Michael Jozwiak, Benton Harbor, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 310 days.

(21) Appl. No.: 16/268,846

(22) Filed: Feb. 6, 2019

(65) Prior Publication Data

US 2020/0245841 A1 Aug. 6, 2020

(51) Int. Cl.
*A47L 15/42* (2006.01)

(52) U.S. Cl.
CPC ..... *A47L 15/4223* (2013.01); *A47L 15/4225* (2013.01)

(58) Field of Classification Search
CPC ..... A47L 15/4223; A47L 15/4225
See application file for complete search history.

(56) References Cited

U.S. PATENT DOCUMENTS 3,778,181 A 12/1973 McFarlin
4,392,891 A * 7/1983 Meyers ..... A47L 15/4202 134/10
4,676,717 A 6/1987 Willyard, Jr. et al.
4,691,423 A 9/1987 Willyard, Jr. et al.
4,971,103 A 11/1990 Scaramucci
4,977,924 A 12/1990 Scaramucci
4,982,759 A 1/1991 Scaramucci
5,000,223 A 3/1991 Scaramucci
5,150,733 A 9/1992 Scaramucci
5,181,535 A 1/1993 Scaramucci
5,215,118 A 6/1993 Scaramucci
5,848,601 A * 12/1998 Thies ..... A47L 15/4202 134/104.4

(Continued)

FOREIGN PATENT DOCUMENTS

KR 20180099333 A 9/2018

OTHER PUBLICATIONS https://hambydairysupply.com/pipeline-milking-equipment-spare-parts/gaskets-and-clamps-for-stainless-steel-and-glas/milk-pump-check-valves-flapper-valves/, Hamby Dairy Supply, Milk Pump Check Valves (Flapper Valves), accessed Feb. 6, 2019.

(Continued)

*Primary Examiner* — Benjamin L Osterhout
(74) *Attorney, Agent, or Firm* — McGarry Bair PC

(57) ABSTRACT

A dishwasher having a tub, a sump fluidly coupled to the tub, a discharge outlet, a drain assembly, and a check valve drain assembly including a seat assembly having a body with a first distal end and a second distal end, a fluid passage extending through the body, the body defining a valve seat having a sealing surface about the fluid passage and a flapper assembly operably coupled to the seat assembly and having a moveable portion configured to selectively move between a closed position where the moveable portion seals against the sealing surface and an opened position where the moveable portion raises to allow liquid through the fluid passage.

12 Claims, 8 Drawing Sheets

(56) References Cited

U.S. PATENT DOCUMENTS

| | | | | |
|---|---|---|---|---|
| 6,182,674 | B1 * | 2/2001 | Jozwiak | A47L 15/0049 134/104.1 |
| 6,418,943 | B1 * | 7/2002 | Miller | A47L 15/4202 134/104.1 |
| 9,091,359 | B1 | 7/2015 | Gassaway | |
| 10,064,537 | B2 | 9/2018 | Welch | |
| 2006/0174917 | A1 * | 8/2006 | Hedstrom | A47L 15/0084 134/25.2 |
| 2016/0143504 | A1 * | 5/2016 | Welch | A47L 15/4225 415/182.1 |
| 2017/0127904 | A1 * | 5/2017 | Tobbe | A47L 15/4208 |
| 2019/0223683 | A1 * | 7/2019 | Durham | A47L 15/4217 |

OTHER PUBLICATIONS https://www.ebay.com/itm/NEW-2936-CHECK-VALVE-ASSY-W-GORMAN-RUPP-FLAP-9915-10010-FAST-SHIP-F239-/292116316628, Gormann-Rupp Co., Flapper Check Valve, accessed Feb. 6, 2019.

* cited by examiner

DISHWASHER WITH DRAIN ASSEMBLY AND CHECK VALVE

BACKGROUND

Conventional dishwashers perform cycles of operation on items present in the dishwasher, and have a drain assembly that drains fluids from a sump of the dishwasher to a discharge outlet.

BRIEF DESCRIPTION

An aspect of the disclosure relates to a drain assembly for a dishwasher having a tub, a sump fluidly coupled to the tub, and a discharge outlet, the drain assembly including a drain pump having an impeller to pump fluid from the sump to the discharge outlet, a volute body operably coupled to at least a portion of the drain pump and having an interior at least partially defining a volute for the drain pump, the volute fluidly coupling the sump and having a pump discharge passageway fluidly coupled with the discharge outlet, and a check valve assembly located in the pump discharge passageway and including a seat assembly having a body with a first distal end and a second distal end that forms at least a portion of a geometry of the volute, a fluid passage extending through the body, the body defining a valve seat having a sealing surface about the fluid passage and a flapper assembly operably coupled to the seat assembly and having a moveable portion configured to selectively move between a closed position where the moveable portion seals against the sealing surface and an opened position where the moveable portion raises to allow liquid through the fluid passage.

DETAILED DESCRIPTION

Figure 1:
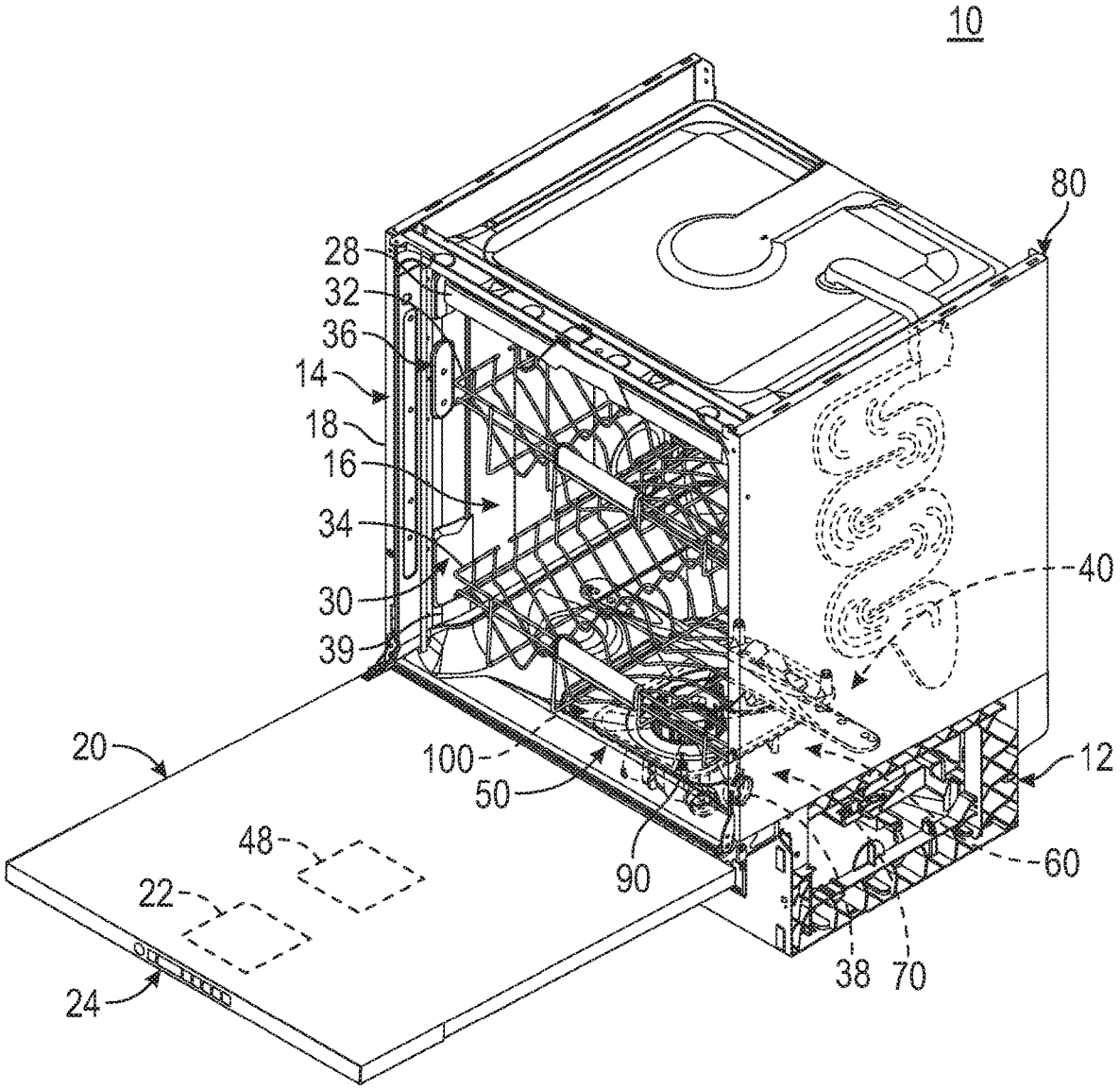
FIG. 1 is a right-side perspective view of an automatic dishwasher having multiple systems for implementing an automatic cycle of operation.

FIG. 1 illustrates an automatic dishwasher 10 capable of implementing an automatic cycle of operation to treat dishes. As used in this description, the term "dish(es)" is intended to be generic to any item, single or plural, that can be treated in the dishwasher 10, including, without limitation, dishes, plates, pots, bowls, pans, glassware, and silverware. As illustrated, the dishwasher 10 is a built-in dishwasher implementation, which is designed for mounting under a countertop. However, this description is applicable to other dishwasher implementations such as a stand-alone, drawer-type or a sink-type, for example.

The dishwasher 10 has a variety of systems, some of which are controllable, to implement the automatic cycle of operation. A chassis is provided to support the variety of systems needed to implement the automatic cycle of operation. As illustrated, for a built-in implementation, the chassis includes a frame in the form of a base 12 on which is supported a open-faced tub 14, which at least partially defines a treating chamber 16, having an open face 18, for receiving the dishes. A closure in the form of a door assembly 20 is pivotally mounted to the base 12 for movement between opened and closed positions to selectively open and close the open face 18 of the tub 14. Thus, the door assembly 20 provides selective accessibility to the treating chamber 16 for the loading and unloading of dishes or other items.

The chassis, as in the case of the built-in dishwasher implementation, can be formed by other parts of the dishwasher 10, like the tub 14 and the door assembly 20, in addition to a dedicated frame structure, like the base 12, with them all collectively forming a uni-body frame to which the variety of systems are supported. In other implementations, like the drawer-type dishwasher, the chassis can be a tub that is slidable relative to a frame, with the closure being a part of the chassis or the countertop of the surrounding cabinetry. In a sink-type implementation, the sink forms the tub and the cover closing the open top of the sink forms the closure. Sink-type implementations are more commonly found in recreational vehicles.

The systems supported by the chassis, while essentially limitless, can include dish holding system 30, spray system 40, recirculation system 50, drain system 60, water supply system 70, drying system 80, heating system 90, and filter system 100. These systems are used to implement one or more treating cycles of operation for the dishes, for which there are many, and one of which includes a traditional automatic wash cycle.

A basic traditional automatic wash cycle of operation has a wash phase, where a detergent/water mixture is recirculated and then drained, which is then followed by a rinse phase where water alone or with a rinse agent is recirculated and then drained. An optional drying phase can follow the rinse phase. More commonly, the automatic wash cycle has multiple wash phases and multiple rinse phases. The multiple wash phases can include a pre-wash phase where water, with or without detergent, is sprayed or recirculated on the dishes, and can include a dwell or soaking phase. There can be more than one pre-wash phases. A wash phase, where water with detergent is recirculated on the dishes, follows the pre-wash phases. There can be more than one wash phase; the number of which can be sensor controlled based on the amount of sensed soils in the wash liquid. One or more rinse phases will follow the wash phase(s), and, in some cases, come between wash phases. The number of wash phases can also be sensor controlled based on the amount of sensed soils in the rinse liquid. The wash phases and rinse phases can included the heating of the water, even to the point of one or more of the phases being hot enough for long enough to sanitize the dishes. A drying phase can follow the rinse phase(s). The drying phase can include a drip dry, heated dry, condensing dry, air dry or any combination.

A controller 22 can also be included in the dishwasher 10 and operably couples with and controls the various components of the dishwasher 10 to implement the cycle of operation. The controller 22 can be located within the door assembly 20 as illustrated, or it can alternatively be located somewhere within the chassis. The controller 22 can also be operably coupled with a control panel or user interface 24 for receiving user-selected inputs and communicating information to the user. The user interface 24 can include operational controls such as dials, lights, switches, and displays enabling a user to input commands, such as a cycle of operation, to the controller 22 and receive information.

The dish holding system 30 can include any suitable structure for holding dishes within the treating chamber 16. Exemplary dish holders are illustrated in the form of upper dish racks 32 and lower dish rack 34, commonly referred to as "racks," which are located within the treating chamber 16. The upper dish racks 32 and the lower dish rack 34 are typically mounted for slidable movement in to and out of the treating chamber 16 through the open face 18 for ease of loading and unloading. Drawer guides/slides/rails 36 are typically used to slidably mount the upper dish rack 32 to the tub 14. The lower dish rack 34 typically has wheels or rollers 38 that roll along rails 39 formed in sidewalls of the tub 14 and onto the door assembly 20, when the door assembly 20 is in the opened position.

Dedicated dish holders can also be provided. One such dedicated dish holder is a third level rack 28 located above the upper dish rack 32. Like the upper dish rack 32, the third level rack is slidably mounted to the tub 14 with drawer guides/slides/rails 36. The third level rack 28 is typically used to hold dishes in the form of utensils, such as tableware, spoons, knives, spatulas, etc., in an on-the-side or flat orientation. However, the third level rack 28 is not limited to holding utensils. If an item can fit in the third level rack, it can be washed in the third level rack 28. The third level rack 28 generally has a much shorter height or lower profile than the upper and lower dish racks 32, 34. Typically, the height of the third level rack is short enough that a typical glass cannot be stood vertically in the third level rack 28 and have the third level rack 28 still slide into the treating chamber 16.

Another dedicated dish holder can be a silverware basket (not shown), which is typically carried by one of the upper or lower dish racks 32, 34 or mounted to the door assembly 20. The silverware basket typically holds utensils and the like in an upright orientation as compared to the on-the-side or flat orientation of the third level rack 28.

A dispenser assembly 48 is provided to dispense treating chemistry, e.g. detergent, rinse agent, anti-spotting agent, etc., into the treating chamber 16. The dispenser assembly 48 can be mounted on an inner surface of the door assembly 20, as shown, or can be located at other positions within the chassis. The dispenser assembly 48 can dispense one or more types of treating chemistries. The dispenser assembly 48 can be a single-use dispenser or a bulk dispenser, or a combination of both.

Figure 2:
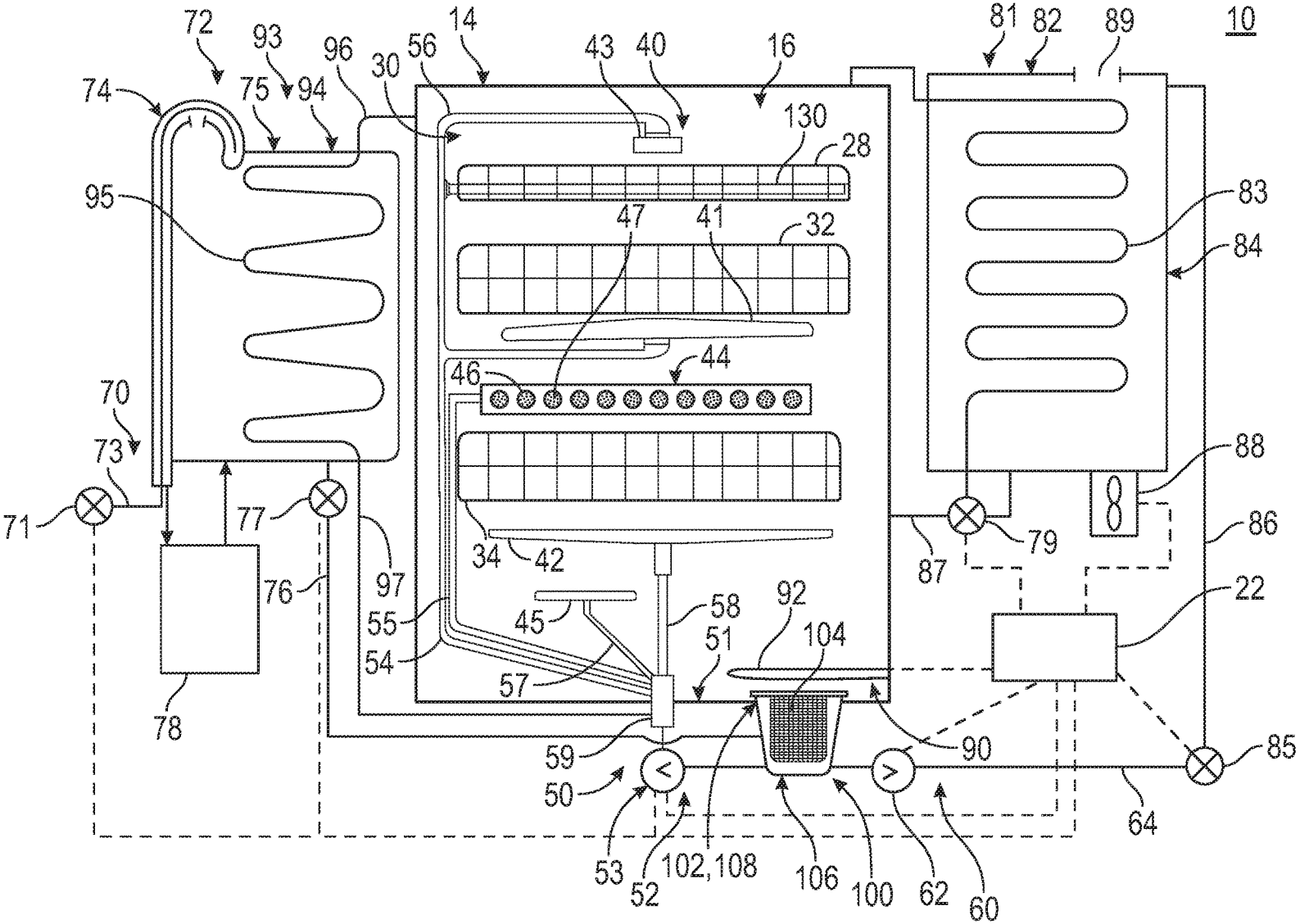
FIG. 2 is a schematic view of the dishwasher of FIG. 1 and illustrating at least some of the plumbing and electrical connections between at least some of systems.

Turning to FIG. 2, the spray system 40 is provided for spraying liquid in the treating chamber 16 and can have multiple spray assemblies or sprayers, some of which can be dedicated to a particular one of the dish holders, to a particular area of a dish holder, to a particular type of cleaning, or to a particular level of cleaning, etc. The sprayers can be fixed or movable, such as rotating, relative to the treating chamber 16 or dish holder. Six exemplary sprayers are illustrated and include, an upper spray arm 41, a lower spray arm 42, a third level sprayer 43, a deep-clean sprayer 44, and a spot sprayer 45. The upper spray arm 41 and lower spray arm 42 are rotating spray arms, located below the upper dish rack 32 and lower dish rack 34, respectively, and rotate about a generally centrally located and vertical axis. The third level sprayer 43 is located above the third level rack 28 about a longitudinal axis. The third level sprayer 43 is illustrated as being fixed, but could move, such as in rotating. In addition to the third level sprayer 43 or in place of the third level sprayer 43, the sprayer 130 can be located at least in part below a portion of the third level rack 28. The sprayer 130 is illustrated as a fixed tube, carried by the third level rack 28, but could move, such as in rotating about a longitudinal axis.

The deep-clean sprayer 44 is a manifold extending along a rear wall of the tub 14 and has multiple nozzles 46, with multiple apertures 47, generating an intensified and/or higher pressure spray than the upper spray arm 41, the lower spray arm 42, or the third level sprayer 43. The nozzles 46 can be fixed or move, such as in rotating. The spray emitted by the deep-clean sprayer 44 defines a deep clean zone, which in the illustrated example can be defined along a rear side of the lower dish rack 34. Thus, dishes needing deep cleaning, such as dishes with baked-on food, can be located in the lower dish rack 34 to face the deep-clean sprayer 44. The deep-clean sprayer 44, while illustrated as only one unit on a rear wall of the tub 14 could comprises multiple units and/or extend along multiple portions, including different walls, of the tub 14, and can be provide above, below or beside any of the dish holders where deep-cleaning is desired.

The spot sprayer 45, like the deep-clean sprayer, can emit an intensified and/or higher pressure spray, especially to a discrete location within one of the dish holders. While the spot sprayer 45 is shown below the lower dish rack 34, it could be adjacent any part of any dish holder or along any wall of the tub where special cleaning is desired. In the illustrated location below the lower dish rack 34, the spot sprayer can be used independently of or in combination with the lower spray arm 42. The spot sprayer 45 can be fixed or can move, such as in rotating.

These six sprayers are illustrative examples of suitable sprayers and are not meant to be limiting as to the type of suitable sprayers.

The recirculation system 50 recirculates the liquid sprayed into the treating chamber 16 by the sprayers of the spray system 40 back to the sprayers to form a recirculation loop or circuit by which liquid can be repeatedly and/or continuously sprayed onto dishes in the dish holders. The recirculation system 50 can include a sump 51 and a pump assembly 52. The sump 51 collects the liquid sprayed in the treating chamber 16 and can be formed by a sloped or recess portion of a bottom wall of the tub 14. The pump assembly 52 can include one or more pumps such as recirculation pump 53. The sump 51 can also be a separate module that is affixed to the bottom wall and includes the pump assembly 52.

Multiple supply conduits 54, 55, 56, 57, 58 fluidly couple the sprayers 28-44 to the recirculation pump 53. A recirculation valve 59 can selectively fluidly couple each of the conduits 54-58 to the recirculation pump 53. While each sprayer 28-44 is illustrated as having a corresponding dedicated supply conduit 54-58 one or more subsets, comprising multiple sprayers from the total group of sprayers 28-44, can be supplied by the same conduit, negating the need for a dedicated conduit for each sprayer. For example, a single conduit can supply the upper spray arm 41 and the third level sprayer 43. Another example is that the sprayer 130 is supplied liquid by the conduit 56, which also supplies the third level sprayer 43.

The recirculation valve 59, while illustrated as a single valve, can be implemented with multiple valves. Additionally, one or more of the conduits can be directly coupled to the recirculation pump 53, while one or more of the other conduits can be selectively coupled to the recirculation pump with one or more valves. There are essentially an unlimited number of plumbing schemes to connect the recirculation system 50 to the spray system 40. The illustrated plumbing is not limiting.

A drain system 60 drains liquid from the treating chamber 16. The drain system 60 includes a drain pump 62 fluidly coupled the treating chamber 16 to a drain line 64. As illustrated the drain pump 62 fluidly couples the sump 51 to the drain line 64.

While separate recirculation and drain pumps 53 and 62 are illustrated, a single pump can be used to perform both the recirculating and the draining functions. Alternatively, the drain pump 62 can be used to recirculate liquid in combination with the recirculation pump 53. When both a recirculation pump 53 and drain pump 62 are used, the drain pump 62 is typically more robust than the recirculation pump 53 as the drain pump 62 tends to have to remove solids and soils from the sump 51, unlike the recirculation pump 53, which tends to recirculate liquid which has solids and soils filtered away to some extent.

A water supply system 70 is provided for supplying fresh water to the dishwasher 10 from a household water supply via a household water valve 71. The water supply system 70 includes a water supply unit 72 having a water supply conduit 73 with a siphon break 74. While the water supply conduit 73 can be directly fluidly coupled to the tub 14 or any other portion of the dishwasher 10, the water supply conduit is shown fluidly coupled to a supply tank 75, which can store the supplied water prior to use. The supply tank 75 is fluidly coupled to the sump 51 by a supply line 76, which can include a controllable valve 77 to control when water is released from the supply tank 75 to the sump 51.

The supply tank 75 can be conveniently sized to store a predetermined volume of water, such as a volume required for a phase of the cycle of operation, which is commonly referred to as a "charge" of water. The storing of the water in the supply tank 75 prior to use is beneficial in that the water in the supply tank 75 can be "treated" in some manner, such as softening or heating prior to use.

A water softener 78 is provided with the water supply system 70 to soften the fresh water. The water softener 78 is shown fluidly coupling the water supply conduit 73 to the supply tank 75 so that the supplied water automatically passes through the water softener 78 on the way to the supply tank 75. However, the water softener 78 could directly supply the water to any other part of the dishwasher 10 than the supply tank 75, including directly supplying the tub 14. Alternatively, the water softener 78 can be fluidly coupled downstream of the supply tank 75, such as in-line with the supply line 76. Wherever the water softener 78 is fluidly coupled, it can be done so with controllable valves, such that the use of the water softener 78 is controllable and not mandatory.

A drying system 80 is provided to aid in the drying of the dishes during the drying phase. The drying system as illustrated includes a condensing assembly 81 having a condenser 82 formed of a serpentine conduit 83 with an inlet fluidly coupled to an upper portion of the tub 14 and an outlet fluidly coupled to a lower portion of the tub 14, whereby moisture laden air within the tub 14 is drawn from the upper portion of the tub 14, passed through the serpentine conduit 83, where liquid condenses out of the moisture laden air and is returned to the treating chamber 16 where it ultimately evaporates or is drained via the drain pump 62. The serpentine conduit 83 can be operated in an open loop configuration, where the air is exhausted to atmosphere, a closed loop configuration, where the air is returned to the treating chamber, or a combination of both by operating in one configuration and then the other configuration.

To enhance the rate of condensation, the temperature difference between the exterior of the serpentine conduit 83 and the moisture laden air can be increased by cooling the exterior of the serpentine conduit 83 or the surrounding air. To accomplish this, an optional cooling tank 84 is added to the condensing assembly 81, with the serpentine conduit 83 being located within the cooling tank 84. The cooling tank 84 is fluidly coupled to at least one of the spray system 40, recirculation system 50, drain system 60, or water supply system 70 such that liquid can be supplied to the cooling tank 84. The liquid provided to the cooling tank 84 from any of the systems 40-70 can be selected by source and/or by phase of cycle of operation such that the liquid is at a lower temperature than the moisture laden air or even lower than the ambient air.

As illustrated, the liquid is supplied to the cooling tank 84 by the drain system 60. A valve 85 fluidly connects the drain line 64 to a supply conduit 86 fluidly coupled to the cooling tank 84. A return conduit 87 fluidly connects the cooling tank 84 back to the treating chamber 16 via a return valve 79. In this way a fluid circuit is formed by the drain pump 62, drain line 64, valve 85, supply conduit 86, cooling tank 84, return valve 79 and return conduit 87 through which liquid can be supplied from the treating chamber 16, to the cooling tank 84, and back to the treating chamber 16. Alternatively, the supply conduit 86 could fluidly couple to the drain line 64 if re-use of the water is not desired.

To supply cold water from the household water supply via the household water valve 71 to the cooling tank 84, the water supply system 70 would first supply cold water to the treating chamber 16, then the drain system 60 would supply the cold water in the treating chamber 16 to the cooling tank 84. It should be noted that the supply tank 75 and cooling tank 84 could be configured such that one tank performs both functions.

The drying system 80 can use ambient air, instead of cold water, to cool the exterior of the serpentine conduit 83. In such a configuration, a blower 88 is connected to the cooling tank 84 and can supply ambient air to the interior of the cooling tank 84. The cooling tank 84 can have a vented top 89 to permit the passing through of the ambient air to allow for a steady flow of ambient air blowing over the serpentine conduit 83.

The cooling air from the blower 88 can be used in lieu of the cold water or in combination with the cold water. The cooling air will be used when the cooling tank 84 is not filled with liquid. Advantageously, the use of cooling air or cooling water, or combination of both, can be selected on the site-specific environmental conditions. If ambient air is cooler than the cold water temperature, then the ambient air can be used. If the cold water is cooler than the ambient air, then the cold water can be used. Cost-effectiveness can also be taken into account when selecting between cooling air and cooling water. The blower 88 can be used to dry the interior of the cooling tank 84 after the water has been drained. Suitable temperature sensors for the cold water and the ambient air can be provided and send their temperature signals to the controller 22, which can determine which of the two is colder at any time or phase of the cycle of operation.

A heating system 90 is provided for heating water used in the cycle of operation. The heating system 90 includes a heater 92, such as an immersion heater, located in the treating chamber 16 at a location where it will be immersed by the water supplied to the treating chamber 16. The heater 92 need not be an immersion heater, it can also be an in-line heater located in any of the conduits. There can also be more than one heater 92, including both an immersion heater and an in-line heater.

The heating system 90 can also include a heating circuit 93, which includes a heat exchanger 94, illustrated as a serpentine conduit 95, located within the supply tank 75, with a supply conduit 96 supplying liquid from the treating chamber 16 to the serpentine conduit 95, and a return conduit 97 fluidly coupled to the treating chamber 16. The heating circuit 93 is fluidly coupled to the recirculation pump 53 either directly or via the recirculation valve 59 such that liquid that is heated as part of a cycle of operation can be recirculated through the heat exchanger 94 to transfer the heat to the charge of fresh water residing in the supply tank 75. As most wash phases use liquid that is heated by the heater 92, this heated liquid can then be recirculated through the heating circuit 93 to transfer the heat to the charge of water in the supply tank 75, which is typically used in the next phase of the cycle of operation.

A filter system 100 is provided to filter un-dissolved solids from the liquid in the treating chamber 16. The filter system 100 includes a coarse filter 102 and a fine filter 104, which can be a removable basket 106 residing the sump 51, with the coarse filter 102 being a screen 108 circumscribing the removable basket 106. Additionally, the recirculation system 50 can include a rotating filter in addition to or in place of the either or both of the coarse filter 102 and fine filter 104. Other filter arrangements are contemplated such as an ultra-filtration system.

Figure 3:
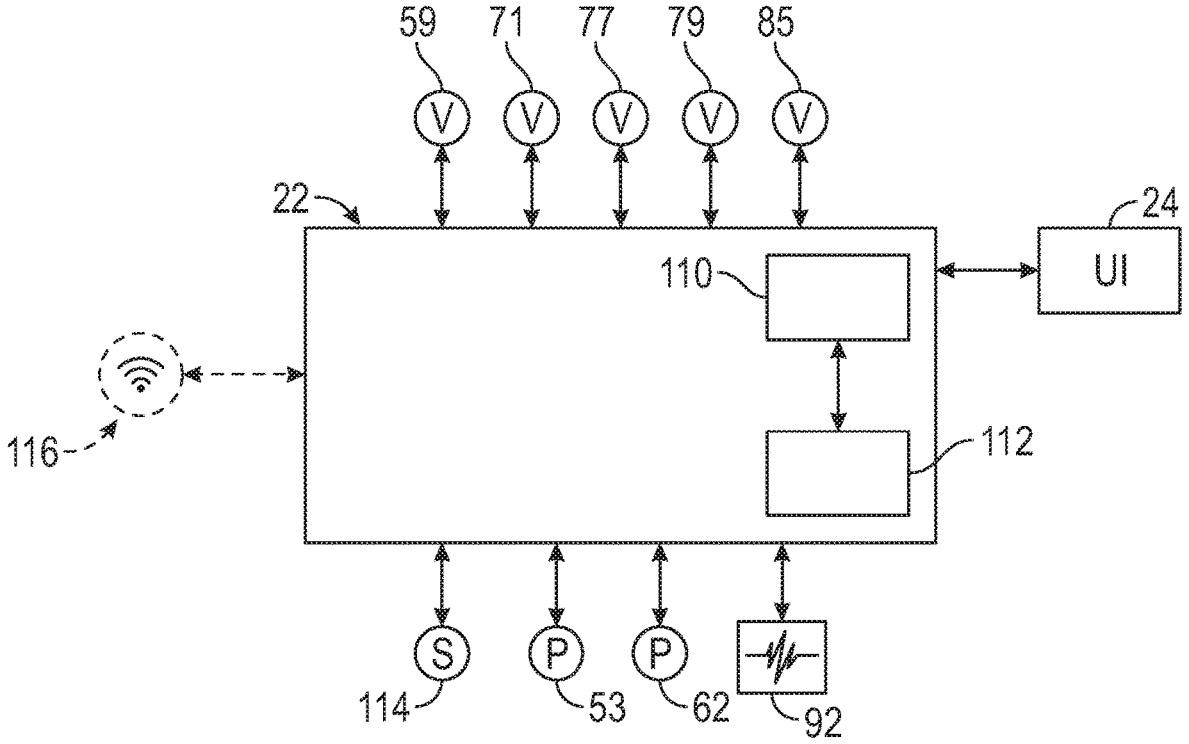
FIG. 3 is a schematic view of a controller of the dishwasher of FIGS. 1 and 2.

As illustrated schematically in FIG. 3, the controller 22 can be coupled with the heater 92 for heating the wash liquid during a cycle of operation, the drain pump 62 for draining liquid from the treating chamber 16, and the recirculation pump 53 for recirculating the wash liquid during the cycle of operation. The controller 22 can be provided with a memory 110 and a central processing unit (CPU) 112. The memory 110 can be used for storing control software that can be executed by the CPU 112 in completing a cycle of operation using the dishwasher 10 and any additional software. For example, the memory 110 can store one or more pre-programmed automatic cycles of operation that can be selected by a user and executed by the dishwasher 10. The controller 22 can also receive input from one or more sensors 114. Non-limiting examples of sensors that can be communicably coupled with the controller 22 include, to name a few, ambient air temperature sensor, treating chamber temperature sensor, water supply temperature sensor, door open/close sensor, and turbidity sensor to determine the soil load associated with a selected grouping of dishes, such as the dishes associated with a particular area of the treating chamber. The controller 22 can also communicate with the recirculation valve 59, the household water valve 71, the controllable valve 77, the return valve 79, and the valve 85. Optionally, the controller 22 can include or communicate with a wireless communication device 116.

Figure 4:
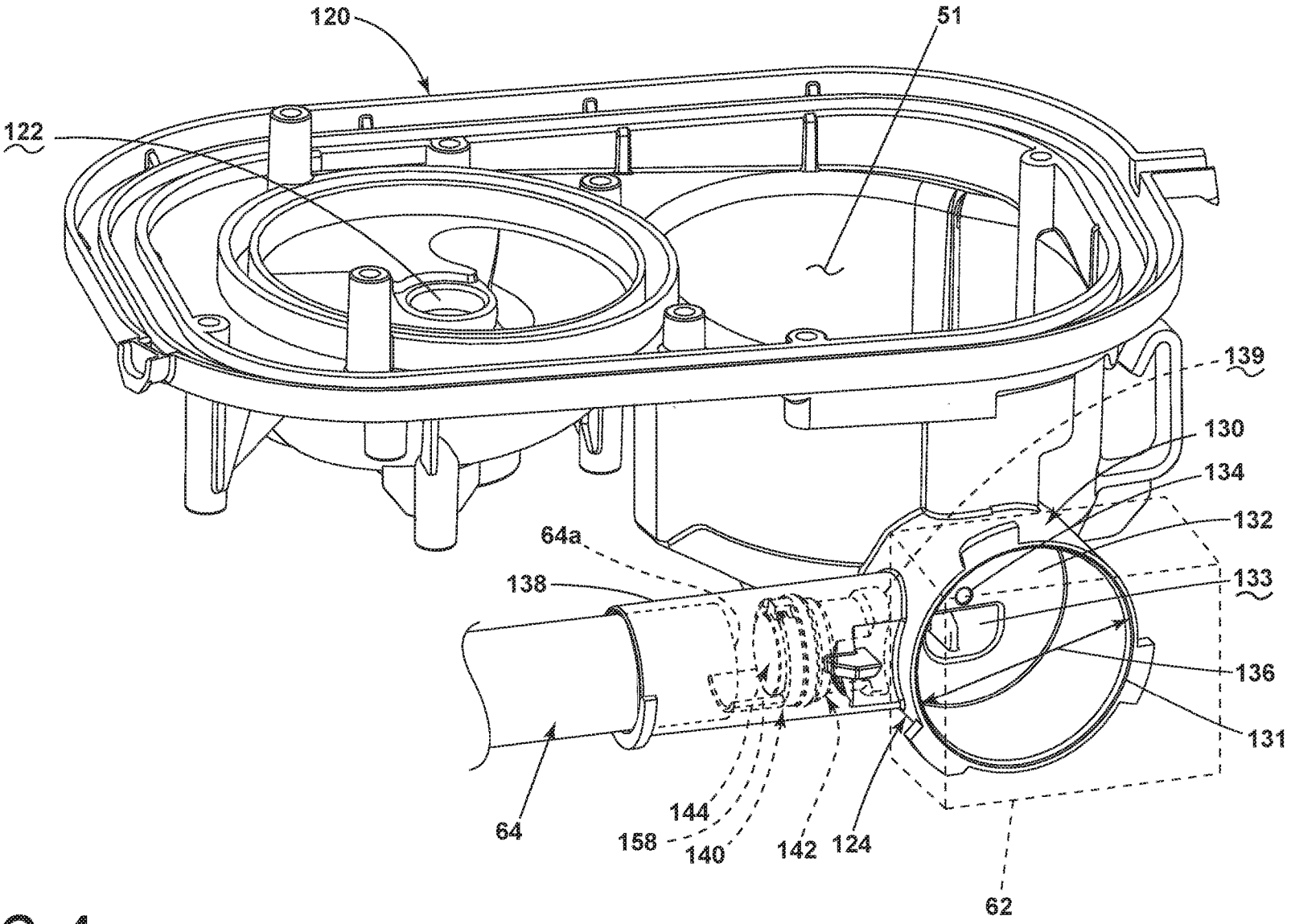
FIG. 4 is a perspective view of a portion of a sump assembly and drain assembly that can be utilized in the dishwasher of FIG. 1.

FIG. 4 illustrates a sump assembly 120 that can be included in the dishwasher 10 and includes among other things, the sump 51 and a recirculation outlet 122 configured to receive liquid from the recirculation pump 53 and where the recirculation outlet 122 can be configured to fluidly couple with the recirculation valve 59 and the multiple supply conduits 54, 55, 56, 57, 58. In the illustrated example, the sump 51 is defined by a peripheral wall extending upwards from a base.

A drain assembly 124 is also illustrated and includes the drain pump 62, the drain line 64, a volute 130, and a check valve assembly 140. As illustrated portions of the sump assembly 120 can be a unitary body including that the volute 130 can be unitarily formed with the sump 51. By way of non-limiting example, the volute 130 can have a first portion 131 that operably couples to the drain pump 62, a second portion 132 illustrated as a rear surface includes an opening 133 that fluidly couples the volute 130 to the sump 51 and an air vent 134. While the opening 133 is D-shaped; it is contemplated that openings having other shapes could be used. The example air vent 134 is configured to allow for air to pass therethrough, thereby reducing or preventing air lock conditions. By allowing air to escape, multiple starts and stops of the drain pump 62 can be reduced or eliminated, which may increase customer satisfaction.

The volute 130 can have and a discharge outlet 138 having an opening 139 within the volute 130 and is operably coupled with the drain line 64. More specifically the drain line 64 is illustrated as a hose that can be inserted within the discharge outlet 138. While not specifically shown, it will be understood that an impeller of the drain pump 62 fluidly couples the volute 130 and can be at least partially received within the volute 130, as the volute 130 is the casing that receives the fluid being pumped by the impeller. Further still a diameter 136 of the volute 130 is illustrated.

A check valve assembly 140 for the drain pump 62 is also illustrated and includes a seat assembly 142 and a flapper assembly 144. The check valve assembly 140 includes a stop feature 158 that is configured to prevent over-insertion of the drain line 64 beyond a predetermined point in the discharge outlet 138. As illustrated, a distal end 64*a* of the drain line 64 abuts the stop feature 158 and is prevent from further insertion thereby.

Figure 5:
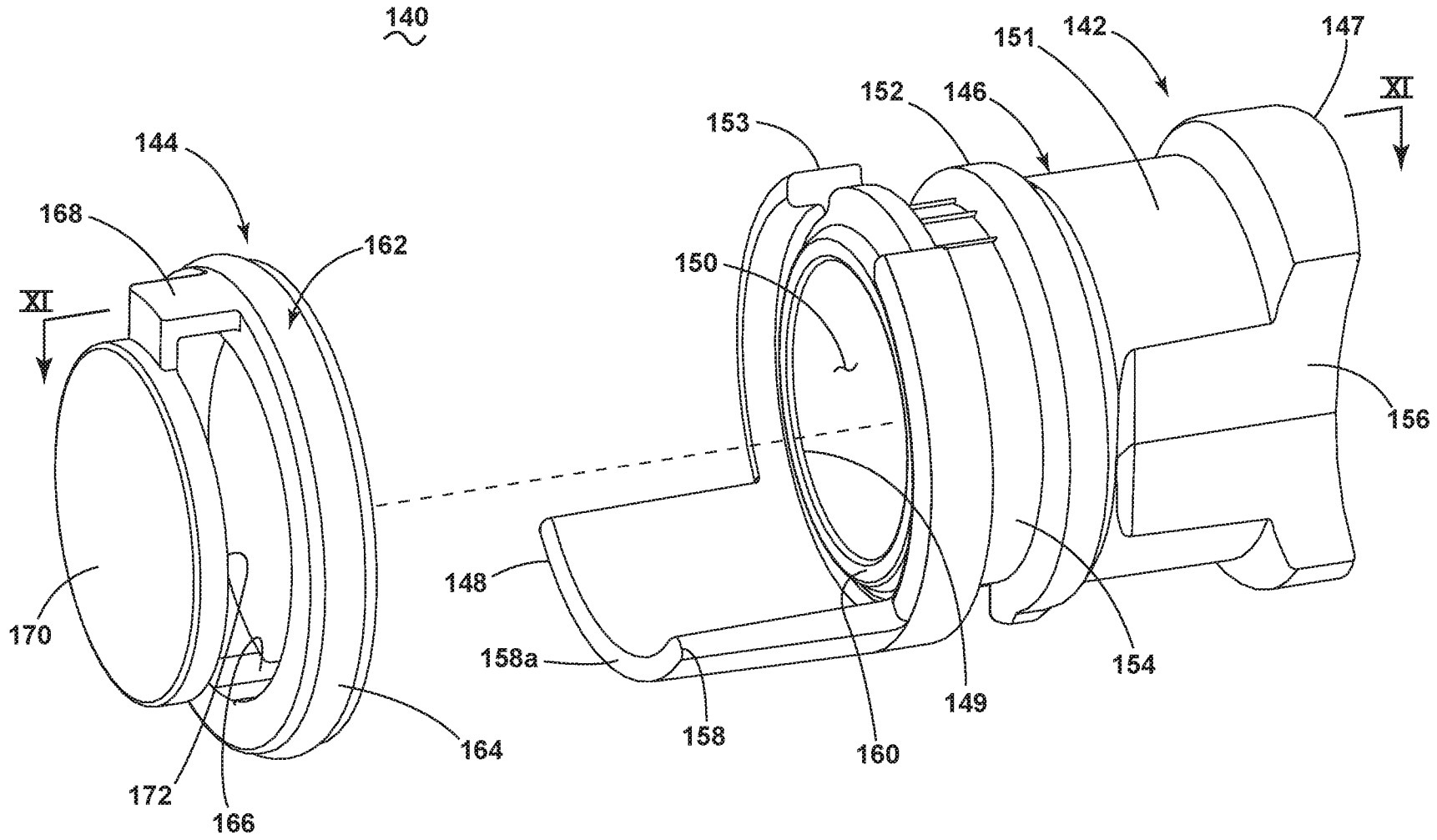
FIG. 5 is an exploded perspective view of a check valve assembly that can be used in the drain assembly of FIG. 4.

FIG. 5 illustrates the seat assembly 142 and the flapper assembly 144 in an exploded view so both can be more easily seen. A body 146 of the seat assembly 142 extends between a first distal end 148 and a second distal end 148. A valve seat 160 is formed in a portion of the body 146 and the first distal end 148 extends lengthwise beyond the valve seat 160 to define an extension 158*a* defining the hose stop feature 158. The extension 158*a* has a concave upper surface and is configured to prevent insertion of the drain hose 64 past the first distal end 148.

An inner diameter 149 of the body 146 defines a fluid passage 150 extending through the body 146. The fluid passage 150 extends through the valve seat 160 and a sealing surface of the valve seat 160 extends about the fluid passage 150. It will be understood that the body 146 of the seat assembly 142 is illustrated merely in a non-limiting example and that any suitable body can be utilized. In the illustrated example an outside profile 151 of the body 146 includes a first rib 152 spaced from a second rib 153 forming a catch 154 there between. It will be understood that neither the first rib 152 nor the second rib 153 need be formed the entire way around the outside profile 151 of the body 146 of the seat assembly 142. Further still, the first rib 152 and/or the second rib 153 can have varying contours about the outside profile 151 of the body 146 of the seat assembly 142. In the illustrated example, the second rib 153 is not fully formed at an upper portion of the body 146 to allow for portions of the flapper assembly 144.

An alignment feature 156 is also provided on the outside profile of the body 146 of the seat assembly 142. The alignment feature 156 is configured to aid in placement of the check valve assembly 140 within the pump discharge passageway 138. More specifically, the alignment feature 156 is illustrated as a first contour that is complementary to a second contour within a portion of the pump discharge passageway 138. It will be understood that the alignment feature 156 can be any suitable alignment feature. In the instant case the outside perimeter includes a concave contour, profile, or shape forming the alignment feature and a portion of the second distal end and the pump discharge passageway includes a convex contour complementary to the alignment feature 156.

A body 162 of the flapper assembly 144 includes a ring 164 having an inner diameter 166 that can be fit about the catch 154 such that the ring 164 can be retained between the first rib 152 and the second rib 153. A hinge 168 is operably coupled to ring 164 and extends therefrom and operably couples a flapper portion or moveable portion 170 having a sealing face 172 to the ring 164.

Figure 6:
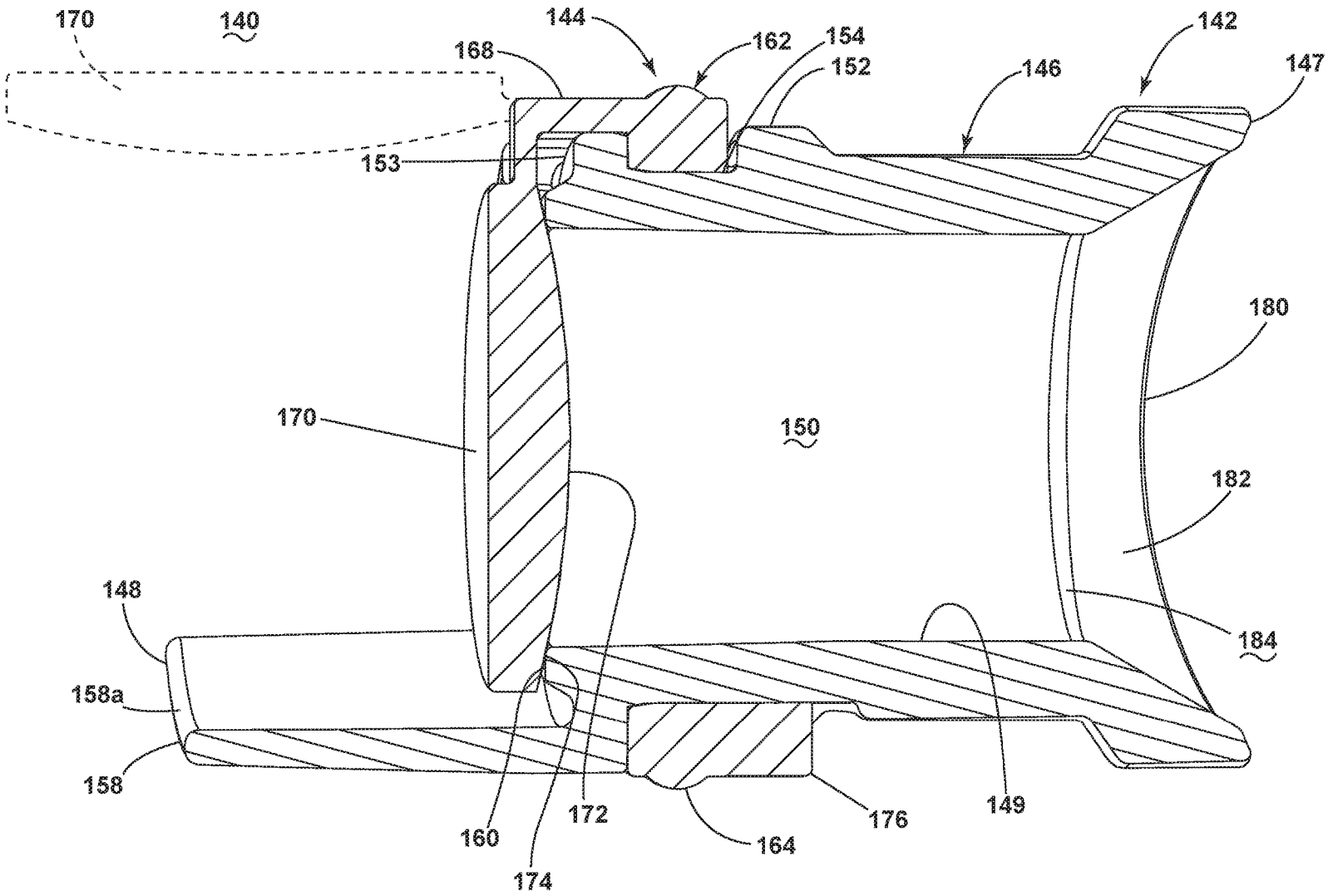
FIG. 6 is cross-sectional view of the assembled check valve assembly of FIG. 5.

As better seen in the cross-section of FIG. 6 the sealing face 172 of the moveable portion of the flapper assembly 144 has a larger diameter than a diameter of the valve seat 160. The moveable portion 170 of the flapper assembly 140 is moveable between a sealed position and an opened position (shown in phantom). In the sealed position or closed position, the sealing face 172 abuts the valve seat 160 and a seal is formed at 174. More specifically, the hinge 168 allows the moveable portion 170 to pivot upwards and downwards at the hinge 168. In the opened position (shown in phantom), the sealing face 172 is generally horizontal and aligned with the hinge 168 such that the moveable portion 170 allows for a flow of liquid through the check valve assembly 140. It can also be seen that the extension 158*a*, which forms the stop feature 158, has a length that is at least even with an extent of the moveable portion 170 when it is located in the opened position (shown in phantom). The concave profile of the stop feature 158 also allows for movement of the moveable portion 170 there above.

Also illustrated is that the ring 164 of the flapper assembly also includes a keyed extension 176 that can be received within a corresponding groove portion of the outside profile 151 of the body 146 of the seat assembly 142 such the flapper assembly 144 can be properly aligned on the seat assembly 142. It is contemplated that the body 162 of the flapper assembly 144 can be a unitary body, The body 162 of the flapper assembly can be formed from any suitable material including, by way of non-limiting example, silicone, which would allow for the ring 164 to be placed within the catch and for the hinge 168 to move during operation without tearing.

Figure 7:
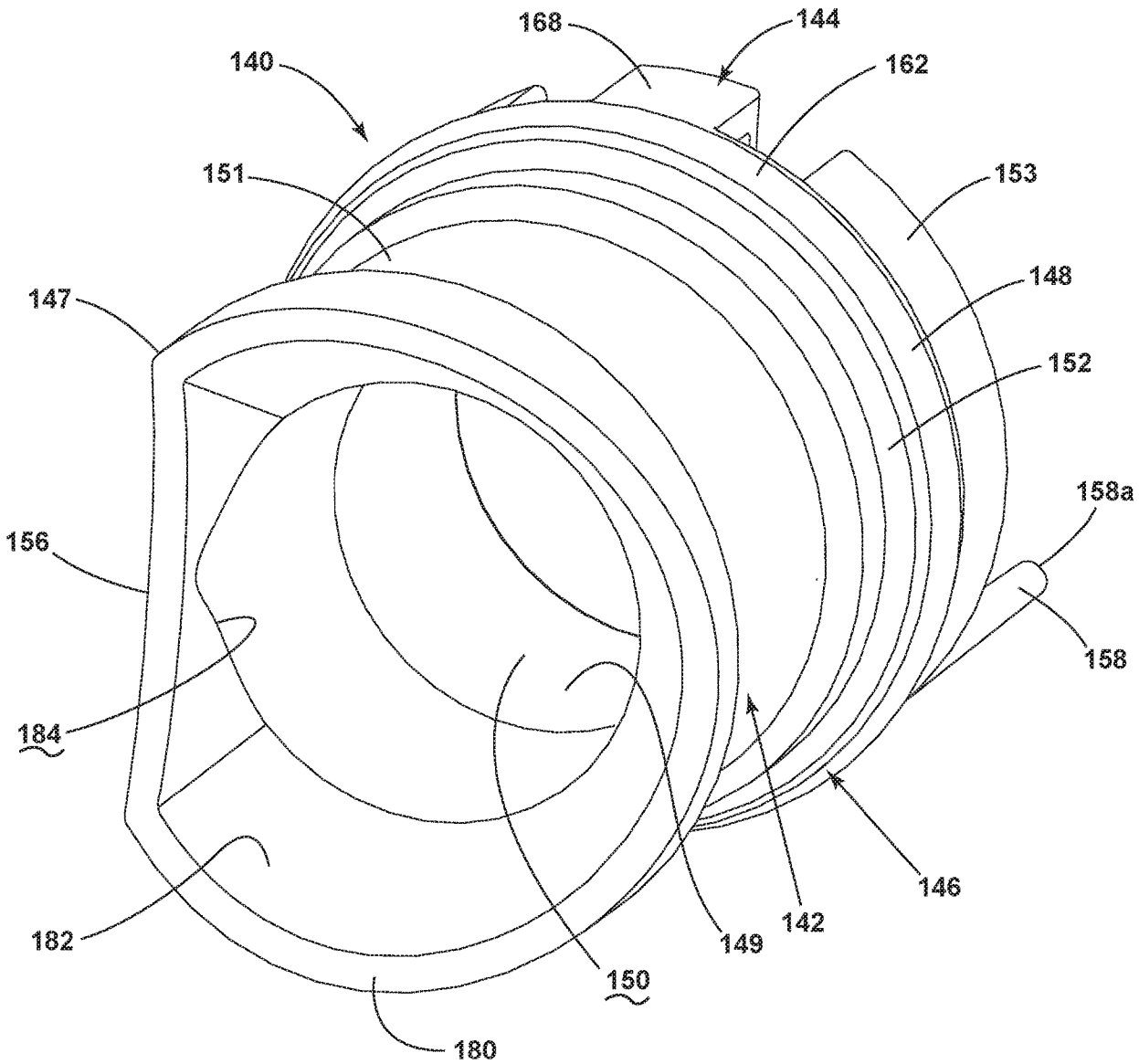
FIG. 7 is a rear perspective view of the assembled check valve assembly of FIG. 5.
Figure 8:
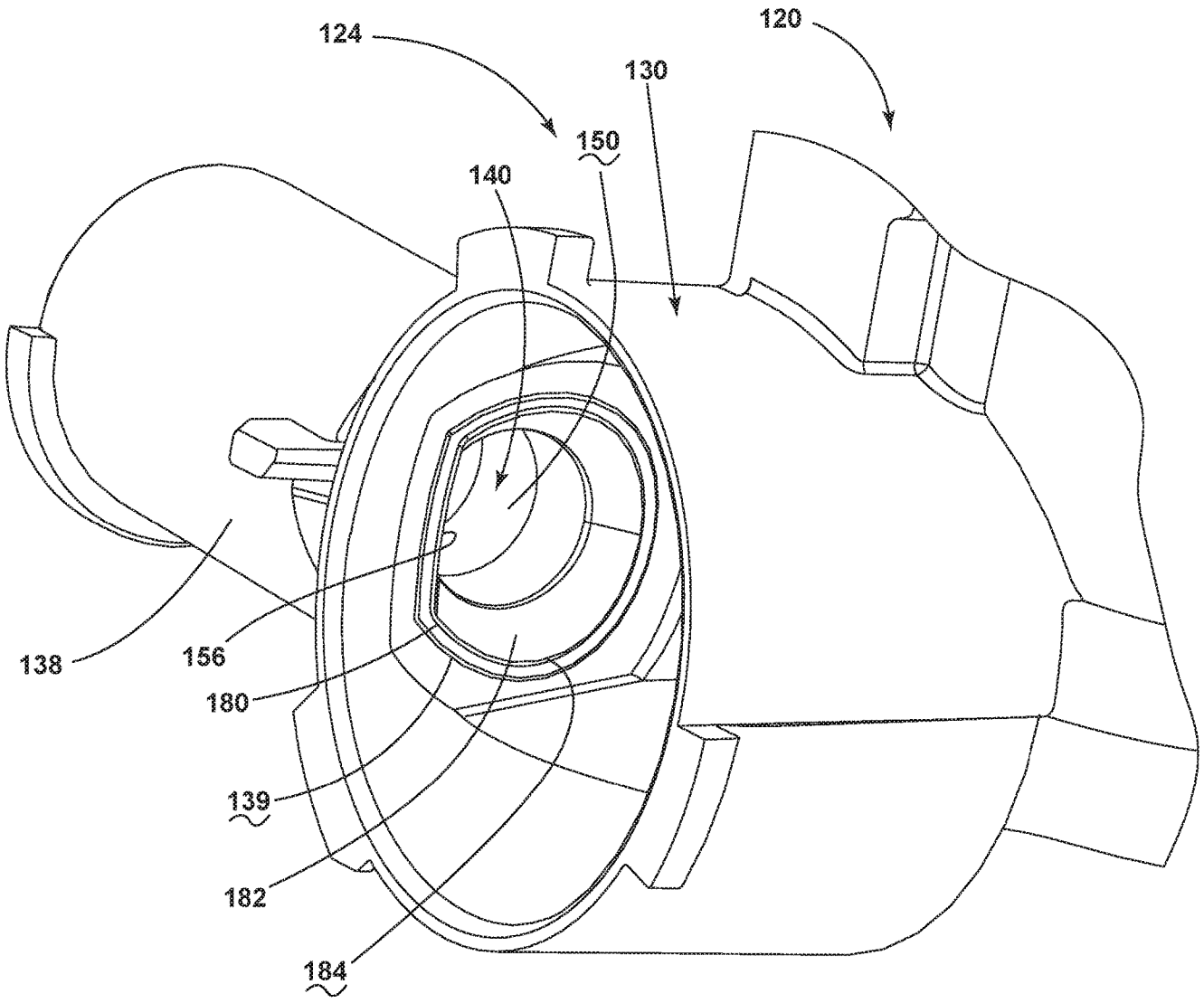
FIG. 8 is a partial perspective view of a portion of the sump assembly and drain assembly of FIG. 4.

FIG. 7 illustrates the flapper assembly 144 operably coupled to the seat assembly 142 with the ring 164 located between the first rib 152 and the second rib 153. The view illustrated shows the second distal end 147 of the body 146 of the seat assembly 142 in more clarity. More specifically it can be seen that an outermost edge 180 of the distal end is countered and not round. A ramped portion 182 leads from the outer edge 180 to an entrance 184 to the fluid passage 150 formed within the body 146 of the seat assembly 142. It will be understood that a portion of the alignment feature 156 aids in shaping the outer edge 180 and the ramped portion 182 although this need not be the case. The outer edge 180 and ramped portion 182 form a portion of a geometry of the volute 130 when the check valve assembly 140 is located properly within the discharge outlet 138. This can be more clearly seen with respect to FIG. 8, which illustrates that the check valve assembly 140 has been press fit into the discharge outlet 138 and the outer edge 180 of the second distal end 147 of the body 146 of the seat assembly 142 is within the opening 139 of the discharge outlet 138, extends fully around the opening 139, and sealingly abutted therewith. The outer edge 180 and ramped portion 182 of the second distal end 147 of the body 146 of the seat assembly 142 forms a portion of the geometry of the volute 130. In the illustrated example, the second distal end 147 of the check valve assembly 140 is formed such that a profile of the volute 130 is not round. This is particularly beneficial during operation because the change in contour provided to the volute 130 by the second distal end 147 allows for increased operation efficiency as opposed to a round volute. Further still the diameter 136 of the volute 130 having the contour provided by the second distal end 147 at the discharge outlet 138 can be decreased in size as compared to that of a round volute. More specifically, in the illustrated example, a 10 mm decrease in diameter (From 60 mm to 50 mm) in the volute 130 can be achieved over a round volute and a gain of 5 mm of compression can be achieved.

During operation, liquid is moved from the sump 51, through the opening 133 and into the volute 130 via the impeller of the drain pump 63. The profile of the second distal end 147 of the body 146 of the seat assembly 142 aids in priming the drain pump 62 and increases the performance of the drain pump 62. The impeller of the drain pump 62 in turn pushes the liquid through the discharge outlet 138 and the check valve assembly 140. More specifically, the liquid is pushed against the moveable portion 170, which rotates the moveable portion 170 on the hinge 168 from the closed position to the opened position to allow liquid to flow to the drain line 64.

When operation of the drain pump 62 ceases, the force created by the liquid on the moveable portion 170 also stops and the moveable portion 170 returns to the closed position where the sealing face 172 abuts the valve seat 160 to form a seal that prevents liquid from entering from the drain line 64 into the volute 130. In this manner the check valve assembly 140 prevents dirty water from entering back into the sump assembly 120.

The inclusion of the volute geometry simplifies the design of the pump volute, while also allowing for changes to the discharge area of the volute by modification of the check valve assembly. This is desirable for making changes in pump performance based on application-specific design criteria, such as pumping efficiency, power consumption, noise level or quality, and passage of objects. The integral stop feature eliminates the problem of an over-inserted connecting hose keeping the check valve from opening completely which would cause pump inefficiency and susceptibility to clogging by foreign objects. Existing pumps do not incorporate part of the pump volute in the valve assembly, precluding simple changes to pump discharge geometry. Existing check valve assemblies do not have an integral hose insertion depth stop. The check valve body also includes a feature to ensure correct alignment in the pump assembly. The check valve assembly components are preassembled and pressed into place in the pump discharge nozzle, allowing for a simple assembly operation during manufacturing. In the illustrated example, a portion of the volute 130 lies below a plane defined by the base of the sump 51 of the sump assembly 120. Aspects of the present disclosure allow for a compressed size in both vertical and horizontal directions of the drain assembly, while maintaining pump efficiency. For example a majority of the volute 130 has been illustrated above a plane defined by the base of the sump 51. The overall height of the pump and sump assemblies was compressed roughly an additional 5 mm with no loss in drain pump performance. Additional side benefits may include simplified tooling of the drain volute and reduced assembly torque due to reduced seal diameter.

Aspects of the present disclosure provide a variety of benefits including improvements to manufacturability and modularity of the drain pump assembly. The ability to change the profile of the volute using the second distal end of the check valve assembly geometry allows for the ability to design or optimize the pump performance based on design criteria including desired pumping efficiency, desired power consumption, desired noise level, desired noise quality, and passage of objects. Further still, inclusion of the volute geometry simplifies the design of the pump volute itself, while also allowing for changes to the discharge area of the volute by modification of the check valve assembly. In this manner the sump assembly having the simplified volute can be used in a variety of applications and changes can be provided by merely changing the check valve assembly. Further still, the extension on the check valve assembly valve body prevents over-insertion of a connecting hose such as a drain line or the household drain. This in turn improves performance of the assembly by allowing the moveable portion or flapper of the check valve assembly to open fully when the drain pump is operating because hose over insertion is prevented. The inability to fully open would cause pump inefficiency and susceptibility to clogging by foreign objects.

To the extent not already described, the different features and structures of the various aspects can be used in combination with each other as desired. That one feature cannot be illustrated in all of the aspects is not meant to be construed that it cannot be, but is done for brevity of description. Thus, the various features of the different aspects can be mixed and matched as desired to form new aspects, whether or not the new aspects are expressly described. Combinations or permutations of features described herein are covered by this disclosure.

This written description uses examples to disclose aspects of the disclosure, including the best mode, and also to enable any person skilled in the art to practice aspects of the disclosure, including making and using any devices or systems and performing any incorporated methods. While aspects of the disclosure have been specifically described in connection with certain specific details thereof, it is to be understood that this is by way of illustration and not of limitation. Reasonable variation and modification are possible within the scope of the forgoing disclosure and drawings without departing from the spirit of the disclosure, which is defined in the appended claims.

What is claimed is:

1. A drain assembly for a dishwasher having a tub, a sump fluidly coupled to the tub, and a discharge outlet, the drain assembly comprising:

a drain pump having an impeller to pump fluid from the sump to the discharge outlet;

a volute body operably coupled to at least a portion of the drain pump and having an interior at least partially defining a volute for the drain pump, the volute fluidly coupling the sump and having a pump discharge passageway fluidly coupled with the discharge outlet; and a check valve assembly located in the pump discharge passageway downstream of the drain pump and including a seat assembly having a body with a first distal end and a second distal end that forms at least a portion of a geometry of the volute such that a profile of the volute is not round, a fluid passage extending through the body, the body defining a valve seat having a sealing surface about the fluid passage and a flapper assembly operably coupled to the seat assembly and having a moveable portion configured to selectively move between a closed position where the moveable portion seals against the sealing surface and an opened position where the moveable portion raises to allow liquid through the fluid passage.

2. The drain assembly as defined in claim 1 wherein the pump discharge passageway is configured to receive the discharge outlet in the form of a drain hose.

3. The drain assembly of claim 2 wherein the first distal end extends lengthwise beyond the valve seat to define an extension that is configured to prevent insertion of the drain hose past the first distal end within the pump discharge passageway.

4. The drain assembly of claim 3 wherein the extension has a length that is at least even with an extent of the moveable portion when it is located in the opened position.

5. The drain assembly of claim 3 wherein the extension is concave.

6. The drain assembly of claim 1 wherein an outside profile of the body of the seat assembly further includes a catch and the flapper assembly further includes a ring configured to be retained within the catch and wherein the moveable portion is operably coupled to the ring via a hinge.

7. The drain assembly of claim 6 wherein the outside profile of the body of the seat assembly further comprises an alignment feature configured to aid in placement of the check valve assembly within the pump discharge passageway.

8. The drain assembly of claim 7 wherein the alignment feature comprises a first contour that is complementary to a second contour within a portion of the pump discharge passageway.

9. The drain assembly of claim 1 wherein an outside profile of the body of the seat assembly further comprises an alignment feature configured to aid in placement of the check valve assembly within the pump discharge passageway.

10. The drain assembly of claim 9 wherein the pump discharge passageway includes a contour complementary to the alignment feature.

11. The drain assembly of claim 1 wherein the sump is defined by a peripheral wall extending upwards from a base and wherein a portion of the volute lies below a plane defined by the base.

12. The drain assembly of claim 1 wherein the volute further comprises a surface having an air vent passageway defined therethrough.

* * * * *